United States Patent [19]

Buhr

[11] Patent Number: 4,809,974

[45] Date of Patent: Mar. 7, 1989

[54] METHOD OF ATTACHING A WRIST TO A BAR FOR EXERCISING

[76] Inventor: Tony W. Buhr, 1910 E. Park Pl., No. 2, Milwaukee, Wis. 53211

[21] Appl. No.: 215,986

[22] Filed: Jul. 7, 1988

Related U.S. Application Data

[62] Division of Ser. No. 115,878, Nov. 2, 1987.

[51] Int. Cl.[4] ..... A63B 13/00

[52] U.S. Cl. ..... 272/119; 272/123; 272/143; 224/250; 294/25

[58] Field of Search ..... 272/67, 68, 93, 117, 272/119, 122, 123, 134, 143; 224/218, 219, 222, 250, 267; 294/25; 273/165, 166

[56] References Cited

U.S. PATENT DOCUMENTS

| | | | |
|---|---|---|---|
| 2,522,719 | 9/1950 | Johnson | 224/250 X |
| 3,334,898 | 8/1967 | McCrory et al. | 272/119 |
| 3,541,990 | 11/1970 | Du Mas | 272/123 X |
| 4,351,526 | 9/1982 | Schwartz | 272/119 X |
| 4,355,801 | 10/1982 | Thomsen | 272/119 |
| 4,478,414 | 10/1984 | Molloy | 272/134 |
| 4,484,740 | 11/1984 | Green | 272/119 |
| 4,487,412 | 12/1984 | Meeko | 272/123 |
| 4,684,122 | 8/1987 | Desmond et al. | 272/143 X |

FOREIGN PATENT DOCUMENTS

| | | | |
|---|---|---|---|
| 148283 | 7/1951 | Australia | 224/267 |
| 116670 | 8/1984 | European Pat. Off. | 272/119 |

OTHER PUBLICATIONS

Advertisement for "Conway Lat Straps" in Iron Man Magazine; Jul. 1983; p. 61.

*Primary Examiner*—Vincent Millin
*Assistant Examiner*—Robert W. Bahr
*Attorney, Agent, or Firm*—Andrus, Sceales, Starke & Sawall

[57] ABSTRACT

A method of attaching a user's wrist to a hand gripping portion of an exercise device through the use of an exercise aid. The exercising aid comprises a flat, narrow strap having opposite ends and a length substantially greater than its width with the ends of the strap connected together to form a mobius band. The length of the strap is greater than about 24 inches and less than about 29 inches thus enabling the strap to accommodate different sized hands and wrists. The ends of the exercising aid may be adjustable connected by a hook and loop fastener, or may be sewn together to form an integral structure.

2 Claims, 1 Drawing Sheet

METHOD OF ATTACHING A WRIST TO A BAR FOR EXERCISING

This is a division of application Ser. No. 07/115,878, filed Nov. 2, 1987, pending.

BACKGROUND OF THE INVENTION

The present invention relates to exercising aids, and more particularly to a device that facilitates gripping of an exercise apparatus.

Muscular strength development is typically accomplished by using various types of devices and machines which provide forces to resist movement by a user. Such exercising apparatus are well known in the art with the most common resistive devices employing weights or springs such as the pulley-weight machine, the barbell, and various frictional devices of both mechanical and fluid type.

In order to achieve maximum rates of muscular development, muscles must be exercised independently and with high intensity. Thus, when exercising, it is typical to repeat an exercise motion over the full range of movement of the muscle. In performing such repetitious motions, a user's grip may weaken thus limiting the number of repetitious exercise motions exerted by a user. It would thus be desirable to provide a device which would enhance a user's grip on the exercise apparatus.

One known device functioning as such an exercise aid comprises a strap of woven material having one end forming a loop such that the opposite end may extend through the loop opening to form a noose for receiving a user's wrist. The free end of the strap is then wrapped around the hand grippable portion of an exercise device and held in place by the user's grip. Such device, however, is ackward to install and uncomfortable during use.

SUMMARY OF THE INVENTION

An exercising aid for attaching a user's wrist to a hand grippable portion of an exercise device. The exercising aid comprises a flat, narrow strap having opposite ends and a length substantially greater than its width, and means for connecting the ends of the strap to form a mobius band. The length of the strap is greater than about 24 inches and less than about 29 inches thus enabling the strap to accommodate different sized hands and wrists. Since the strap is in the form of a mobius band, the twist in the strap enables the strap to lie comfortably against the user's hand so as to provide comfort during use.

The ends of the exercising aid may be adjustably connected by means of a hook and loop fastener means, or may be sewn together to form an integral structure. The strap may be made of any suitable material such as woven nylon or leather.

The present invention also provides a method of attaching a user's wrist to a hand grippable portion of an exercise device. The method comprises the steps of providing an exercise device having a hand grippable portion, and providing a flat narrow strap having opposite ends connected together to form a mobius band with a length substantially greater than its width. The length of the strap is greater than about 24 inches and less than about 29 inches. Thereafter, the strap is laid across the bar so that opposite sides of the strap extend beneath the bar and form a pair of aligned hand-receiving openings. The user's hand is then inserted through the aligned openings in a direction substantially transverse to the bar, and thereafter pivoted approximately 90° along a substantially horizontal plane. Finally, the user's hand is turned about 90° into a substantially vertical plane and rotated approximately 90° along the substantially vertical plane to locate the hand in a normal hand grip position about the bar.

The present invention thus provides an exercise aid which is simple, easy to utilize, and comfortable during use. Other features and advantages of the invention will become apparent to those skilled in the art upon reviewing the following detailed description, the drawings, and the impended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
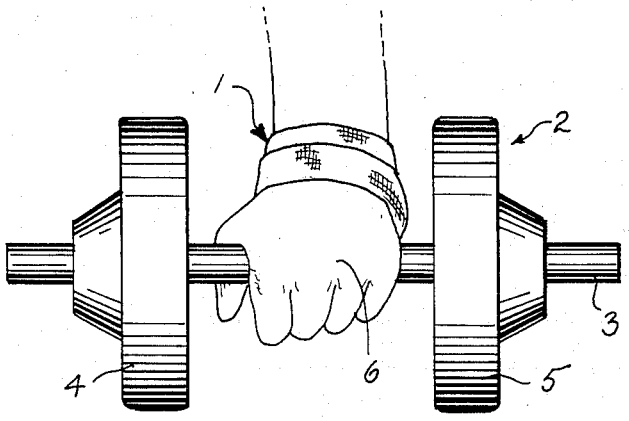
FIG. 1 is a front view in elevation of a user's wrist attached to a dumbbell with an exercise aid constructed in accordance with the present invention.

Referring now to the drawings, FIG. 1 illustrates an exercising aid generally designated by the numeral 1 for attaching a user's wrist to a hand grippable portion of an exercisable device. In particular, FIG. 1 illustrates a dumbbell 2 comprising a short bar 3 with a pair of identical weighted discs 4, 5 attached to each end of bar 3. Bar 3 includes a central hand grippable portion about which a user's hand 6 grips bar 3 for exercising.

Figure 2:
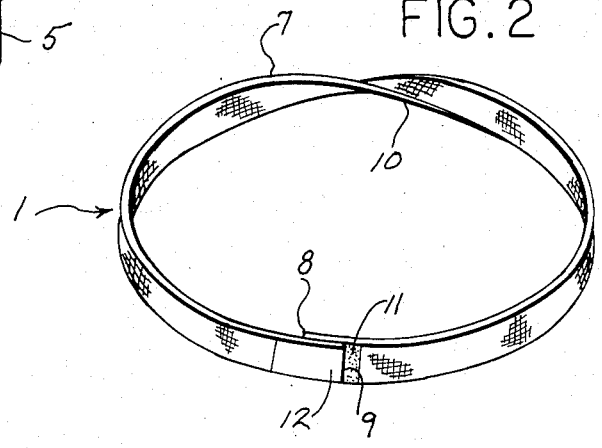
FIG. 2 is a perspective view of a first embodiment of the exercise aid.

Referring now to FIG. 2, exercise aid 1 comprises a flat, narrow strap 7 having opposite ends 8, 9 with a length substantially greater than its width and a thickness substantially less than its width. The length of strap 7 is greater than about 24 inches and less than about 29 inches so as to accommodate different hand and wrist sizes of individual users. Strap 7 may be composed of any relatively strong material such as woven nylon or leather. The width of strap 7 is typically about 0.75 inches to about 1.25 inches with a thickness of from about 1/16 inch to about ⅛ inch.

As shown best in FIG. 2, strap 7 includes a twist 10 formed therein when assembled so as to form a mobius band or strip. As shown best in FIG. 2, the mobius band or strip is formed by holding one end 8 or 9 of strap 7 fixed, rotating the opposite end through 180°, and applying it to the first end. Twist 10 enables strap 7 to lie comfortably wrapped about a user's wrist, as will hereinafter be described.

As also shown in FIG. 2, the ends 8 and 9 of strap 7 are removably connected to each other by means of a hook and loop fastener, typically known under the trade designation "Velcro". Thus, one end 8 of strap 7 includes the hooks while the other end 9 of strap 7 includes the loops, or vice versa. To connect ends 8 and 9, portions 11 and 12 need merely be overlapped a desired amount to adjust the overall length of strap 7 and pressed together. Alternately, ends 8 and 9 of strap 7 may be connected in a nonadjustable manner as by being sewn together to form an integral one piece mobius band. This latter embodiment is shown in FIG. 3 wherein ends 8 and 9 are sewn together as at seam 13.

Figure 3:
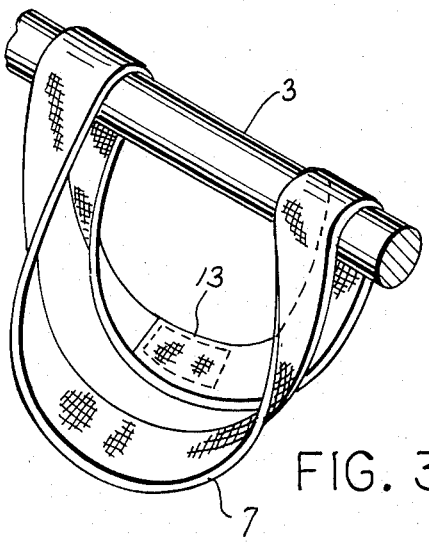
FIG. 3 is a perspective view of a second embodiment of the exercise aid in its initial position across the hand grippable portion of the bar of the dumbbell of FIG. 1.
Figure 4:
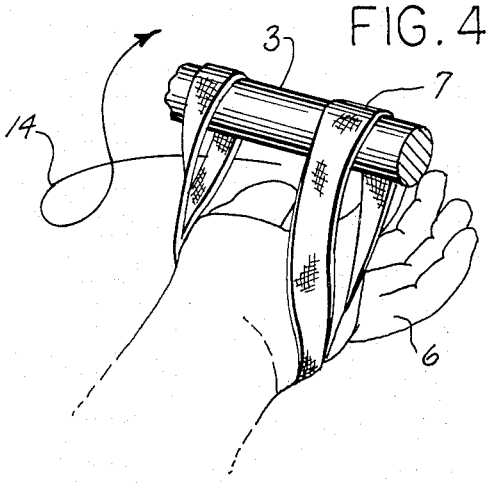
FIG. 4 is a perspective view illustrating the manner of connecting a user's wrist to the bar of the dumbbell using the exercise aid of FIG. 3.
Figure 5:
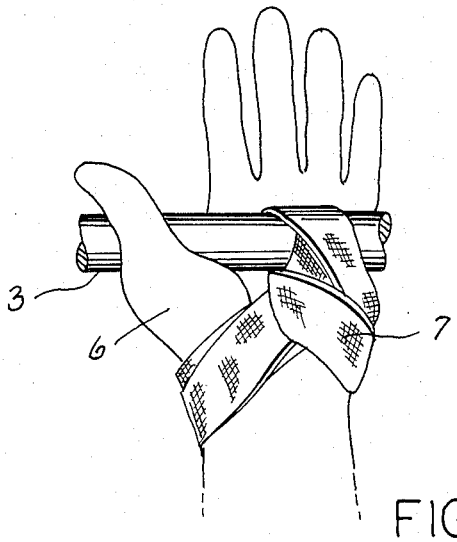
FIG. 5 is a perspective view illustrating the final assembled position of the exercise aid about a user's wrist and the bar of the dumbbell.

Referring now to FIGS. 3–5, the method of using strap 7 is illustrated. As shown best in FIG. 3, strap 7 is first laid or placed across bar 3 so that opposite sides of strap 7 extend beneath bar 3 and form a pair of aligned hand-receiving openings beneath bar 3. Thereafter, a user's hand 6 is inserted through the aligned openings in a direction substantially transverse to the axis of bar 3, as shown best in FIG. 4. Hand 6 is then pivoted approximately 90° along a substantially horizontal plane, and then turned about 90° into a substantially vertical plane and thereafter rotated approximately 90° along the substantially vertical plane to locate hand 6 in a normal hand grip position about bar 3, as shown best in FIGS. 1 and 5. The rotation of hand 6 is illustrated best in FIG. 4 by means of arrow 14. As shown best in FIG. 1, strap 7 lays flat across the back of hand 6 about a user's wrist, and as shown best in FIG. 5 also lays flat across the inside of the user's wrist and the user's palm without any unnecessary kinks or turns so as to provide a comfortable attachment which will not pinch or "cut into" a user's hand or wrist.

An exercising aid has been illustrated and described which advantageously provides for easy and comfortable attachment of a user's hand to a hand grippable portion of an exercise apparatus. Various modifications and/or substitutions of the specific device as described herein may be made without the departing from the scope of the invention. For example, although illustrated in connection with a dumbbell, exercising aid 1 may be employed with any type of exercising device having a hand grippable portion or bar such as dead weight devices or mechanical resistant devices employing weights and/or springs, or similar devices.

Various modes of carrying out the invention are contemplated as being within the scope of the following claims particularly pointing out and distinctly claiming the subject matter which is regarded as the invention.

I claim:

1. A method of attaching a user's wrist to a hand grippable bar of an exercise device, comprising the steps of:

providing an exercise device having a hand grippable bar;

providing a flat, narrow strap having opposite ends connected together to form a mobius band and a length substantially greater than its width;

laying the strap across the bar so that opposite sides of the strap extend beneath the bar and form a pair of aligned hand-receiving openings;

inserting a user's hand through said openings in a direction substantially transverse to said bar;

pivoting the user's hand approximately 90° along a substantially horizontal plane;

turning the user's hand about 90° from said horizontal plane into a substantially vertical plane; and rotating the user's hand approximately 90° along the substantially vertical plane to locate said hand in a normal hand grip position about said bar.

2. The method of claim 1 wherein the length of said strap is greater than about 24 inches and less than about 29 inches.

* * * * *